US008411118B2

(12) United States Patent
Sheu et al.

(10) Patent No.: US 8,411,118 B2
(45) Date of Patent: Apr. 2, 2013

(54) FLAT PANEL DISPLAY AND METHOD FOR DETECTING RESOLUTION OF IMAGE SIGNAL THEREOF

(75) Inventors: Yi-Zhong Sheu, Miao-Li (TW); Jui-Feng Ko, Miao-Li (TW)

(73) Assignee: Chimei Innolux Corporation, Miaoli County (TW)

( * ) Notice: Subject to any disclaimer, the term of this patent is extended or adjusted under 35 U.S.C. 154(b) by 1145 days.

(21) Appl. No.: 12/316,514

(22) Filed: Dec. 12, 2008

(65) Prior Publication Data

US 2009/0153597 A1 Jun. 18, 2009

(30) Foreign Application Priority Data

Dec. 12, 2007 (CN) ..... 2007 1 0124987

(51) Int. Cl.
*G09G 5/02* (2006.01)

(52) U.S. Cl. ..... 345/698; 345/98

(58) Field of Classification Search ..... 345/87–104, 345/60, 76, 82, 204–215, 690–699; 348/312
See application file for complete search history.

(56) References Cited

U.S. PATENT DOCUMENTS

| | | | | |
|---|---|---|---|---|
| 6,670,964 | B1 | 12/2003 | Ward et al. | |
| 6,894,706 | B1 | 5/2005 | Ward et al. | |
| 2005/0078126 | A1 | 4/2005 | Park et al. | |
| 2008/0297511 | A1 * | 12/2008 | Chou et al. | 345/428 |

FOREIGN PATENT DOCUMENTS

| | | | |
|---|---|---|---|
| DE | 10108971 | A1 | 9/2001 |
| KR | 2001-0069145 | A | 7/2001 |

* cited by examiner

*Primary Examiner* — Stephen Sherman
(74) *Attorney, Agent, or Firm* — Bacon & Thomas, PLLC

(57) ABSTRACT

A flat panel display includes a data interface, a scaler control circuit, and a pulse generator configured to provide an independent pulse signal to the scaler control circuit. The data interface is configured to receive an image signal including a vertical synchronization pulse signal and a horizontal synchronization pulse signal. The scaler control circuit is configured to determine a vertical resolution of the image signal by counting a number of pulses of the independent pulse signal respectively between two adjacent vertical synchronization pulses and between two adjacent horizontal synchronization pulses. A method for detecting a resolution of an image signal received by the flat panel display is also provided.

4 Claims, 7 Drawing Sheets

FLAT PANEL DISPLAY AND METHOD FOR DETECTING RESOLUTION OF IMAGE SIGNAL THEREOF

FIELD OF THE DISCLOSURE

The present disclosure relates to flat panel displays, and more particularly to a flat panel display having a scaler control circuit and a method for detecting a resolution of an image signal by using the scaler control circuit.

BACKGROUND

Flat panel displays have gradually replaced cathode ray tube (CRT) displays in display field, because they provide good quality images with little power consumption and are very thin. The flat panel display is usually used in a computer system by connected to a computer host and receives image signals from the computer host to display.

Referring to FIG. 10, a typical computer system 100 includes a computer host 110 and a flat panel display 120 connected to each other via a data transmitting line 130. The data transmitting line 130 is used to transmit image signals and other data signals from the computer host 110 to the flat panel display 120.

The flat panel display 120 includes a plurality of pixels arranged in an M×N matrix, wherein M represents a number of the pixels in a horizontal direction, and N represents a number of the pixels in a vertical direction. Thus, the flat panel display 120 has a fixed resolution of M×N, namely, a fixed horizontal resolution of M and a fixed vertical resolution of N. The flat panel display 120 can display an image signal having a resolution no more than M×N.

The computer host 110 can output image signals having different resolutions, such as 800×600, 1024×768, 1280×1024, and so on. A user can adjust the resolution of the image signal. Thus, the image signal output from the computer host 110 has a variable resolution, namely, a variable horizontal resolution and a variable vertical resolution.

If the flat panel display 120 has a fixed resolution of 1024×768, when an image signal output from the computer host 110 has a resolution of 1280×1024 or 800×600, the flat panel display 120 may be incompatible with the computer host 110. Thus, a display error or an image distortion phenomenon will occur.

A method for resolving the above problems is adjusting a timing of the image signal, namely, scaling the image signal, to make the resolution of the image signal match the fixed resolution of the flat panel display 120. Thus, the resolution of the image signal needs to be detected before scaled. Therefore, a scaler control circuit is usually needed in the flat panel display 120 to detect and scale the resolution of the image signal.

Referring to FIG. 11, a scaler control circuit 200 of the flat panel display 120 is shown. The scaler control circuit 200 includes a horizontal counter 210, a vertical counter 220, a decoder 230, a bypass controller 240, and a scaler unit 250. The horizontal counter 210 and the vertical counter 220 are used to determine the resolution of an image signal received by the flat panel display 120. The decoder 230 is used to analyze the fixed resolution of the flat panel display 120. The bypass controller 240 and the scaler unit 250 are used to scale the image signal to make the resolution of the image signal to match the fixed resolution of the flat panel display 120.

Firstly, the horizontal counter 210 receives a pixel clock (CLK) signal and a data enable (DE) signal, and counts a number of pulses of the CLK signal in a DE valid period. A counting result of the horizontal counter 210 represents a horizontal resolution of the image signal. The vertical counter 220 receives a vertical synchronization pulse (Vsync) signal, a horizontal synchronization pulse (Hsync) signal, and the DE signal, and counts a number of pulses of the DE signal between two adjacent vertical synchronization pulses. A counting result of the vertical counter 220 represents a vertical resolution of the image signal. The decoder 230 receives a panel size signal from a circuit of the flat panel display 120, and analyzes the panel size signal to obtain a fixed resolution of the flat panel display 120.

Secondly, the bypass controller 240 receives the resolution of the image signal and the fixed resolution of the flat panel display 120, compares the resolution of the image signal with the fixed resolution of the flat panel display 120, and outputs a bypass enable signal according to a comparing result. That is, if the resolution of the image signal matches the fixed resolution of the flat panel display 120, the bypass enable signal is output as a starting signal; otherwise, the bypass enable signal is output as an invalid signal.

Finally, the scaler unit 250 receives the image signal, the fixed resolution of the flat panel display 120, and the bypass enable signal. If the bypass enable signal is the starting signal, the scaler unit 250 outputs directly the image signal to a driving circuit of the flat panel display 120. If the bypass enable signal is the invalid signal, the scaler unit 250 scales the resolution of the image signal to match the fixed resolution of the flat panel display 120.

The above method for detecting the resolution of the image signal is directly counting the pulses of the CLK signal and the DE signal via the scaler control circuit 200. That is simple and convenient. The CLK signal and the DE signal are obtained by analyzing the image signal. However, the image signal is liable to be disturbed by other signals or circumstance factors when transmitted from the computer host 110 to the flat panel display 120. Thus, some undesired signals are liable to be superimposed on the CLK signal and the DE signal, namely, the CLK signal and the DE signal may include some undesired pulses. When the scaler control circuit 200 counts the pulses of the CLK signal and the DE signal, the undesired pulses are also counted. Therefore, the accuracy of the method for detecting the resolution of the image signal is low.

Therefore, an improved flat panel display is desired to overcome the above-described deficiencies. A method for detecting the resolution of the image signal is also desired.

SUMMARY

An aspect of the disclosure relates to a flat panel display including a data interface, a scaler control circuit, and a pulse generator configured to provide an independent pulse signal to the scaler control circuit. The data interface is configured to receive an image signal including a vertical synchronization pulse signal and a horizontal synchronization pulse signal. The scaler control circuit is configured to determine a vertical resolution of the image signal by counting a number of pulses of the independent pulse signal respectively between two adjacent vertical synchronization pulses and between two adjacent horizontal synchronization pulses.

Other novel features and advantages will become more apparent from the following detailed description and when taken in conjunction with the accompanying drawings.

BRIEF DESCRIPTION OF THE DRAWINGS

The components in the drawings are not necessarily drawn to scale, the emphasis instead being placed upon clearly illustrating the principles of at least one embodiment. In the drawings, like reference numerals designate corresponding parts throughout the various views.

DETAILED DESCRIPTION

Reference will now be made to the drawings to describe the embodiments in detail.

Figure 1:
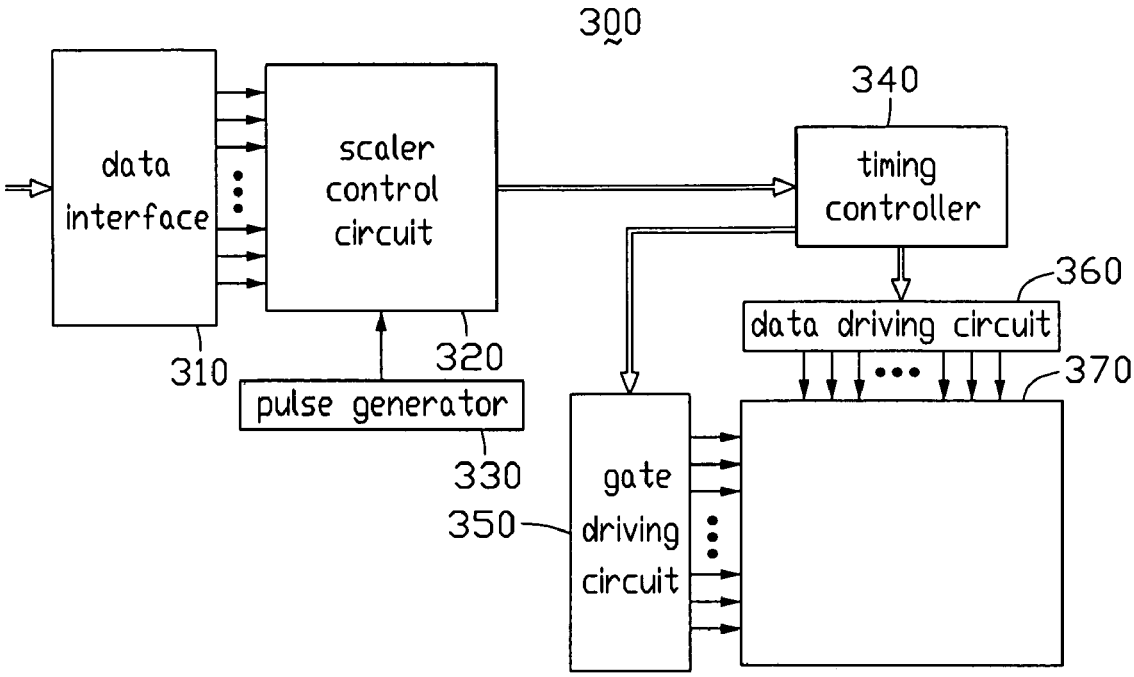
FIG. 1 is a block diagram of a first embodiment of a flat panel display of the present disclosure, the flat panel display including a scaler control circuit.

Referring to FIG. 1, an flat panel display 300 of a first embodiment of the present disclosure includes a data interface 310, a scaler control circuit 320, a pulse generator 330, a timing controller 340, a gate driving circuit 350, a data driving circuit 360, and a display panel 370. The data interface 310 may be a digital visual interface (DVI), and is used to receive an image signal. The scaler control circuit 320 is used to detect and scale a resolution of the image signal. The pulse generator 330 includes a crystal oscillator, and is used to provide an independent pulse (EP) signal to the scaler control circuit 320. The timing controller 340 is used to control the gate driving circuit 350 and the data driving circuit 360. The gate driving circuit 350 and the data driving circuit 360 are used to drive the display panel 370 to display.

Figure 2:
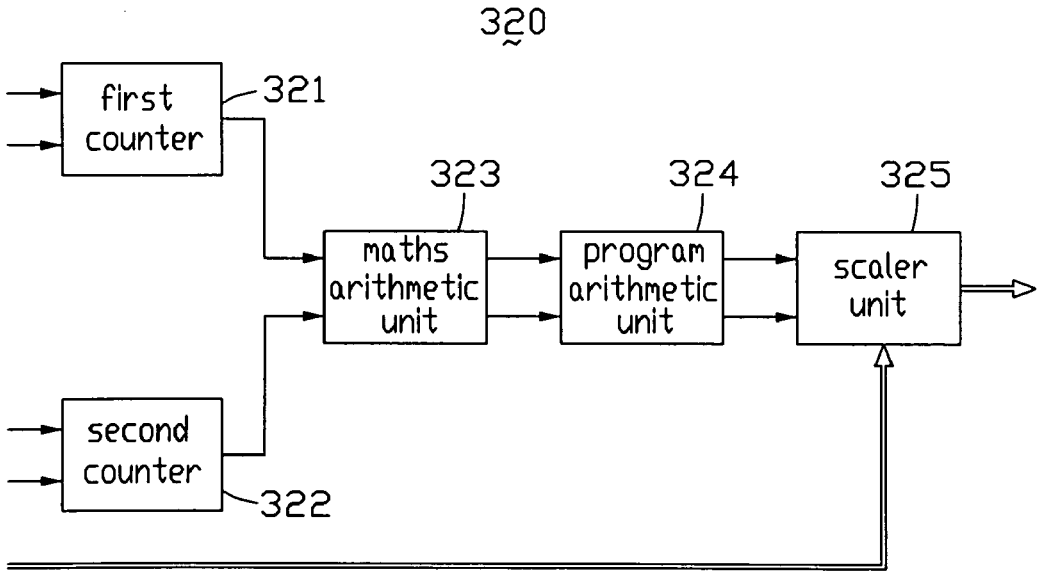
FIG. 2 is a block diagram of the scaler control circuit of FIG. 1.

Referring to FIG. 2, the scaler control circuit 320 includes a first counter 321, a second counter 322, a maths arithmetic unit 323, a program arithmetic unit 324, and a scaler unit 325. The first counter 321 and the second counter 322 are connected to the maths arithmetic unit 323. The maths arithmetic unit 323, the program arithmetic unit 324, and the scaler unit 325 are connected in series. The first counter 321 and the second counter 322 can respectively count pulse signals received by them, and output corresponding counting results. The maths arithmetic unit 323 may be a divider, and provides a division operation to signals inputting thereto. The program arithmetic unit 324 stores software programs that can provide a program operation based on a video electronic standards association (VESA) specification.

Referring to table 1, an illustrative part of the VESA specification is shown. Specifically, the VESA specification provides ranges of video display resolutions, and includes several kinds of formats, such as super extended graphics array (SXGA), wide extended graphics array (WXGA), and so on. For example of SXGA, it has a resolution of 1280×1024, Vtotal of 1066, and Htotal of 1688.

TABLE 1

| | Vtotal | Vactive | Htotal | Hactive |
|---|---|---|---|---|
| SXGA | 1066 | 1024 | 1688 | 1280 |
| WXGA | 926 | 900 | 1600 | 1440 |
| ... | ... | ... | ... | ... |

The program operation of the software programs includes: distinguishing input signals that represent numerical values; determining definite ranges according to the input signals; determining the format proximal to the ranges; and then outputting active horizontal resolution Hactive and active vertical resolution Vactive according to the format.

The flat panel display 300 receives an image signal from an image signal source (not shown) via the data interface 310. The image signal source may be a computer host or other electronic device that can output image signals such as optical disk device. The image signal includes a pixel data (PD) signal and a plurality of timing signals including CLK, DE, Vsync, and Hsync. The data interface 310 outputs the image signal to the scaler control circuit 320. Specifically, the timing signals are provided to the first and second counters 321, 322, and the PD signal is provided to the scaler unit 325. The scaler control circuit 320 detects and scalers a resolution of the image signal, and can uses the following methods to detect the resolution of the image signal.

Figure 3:
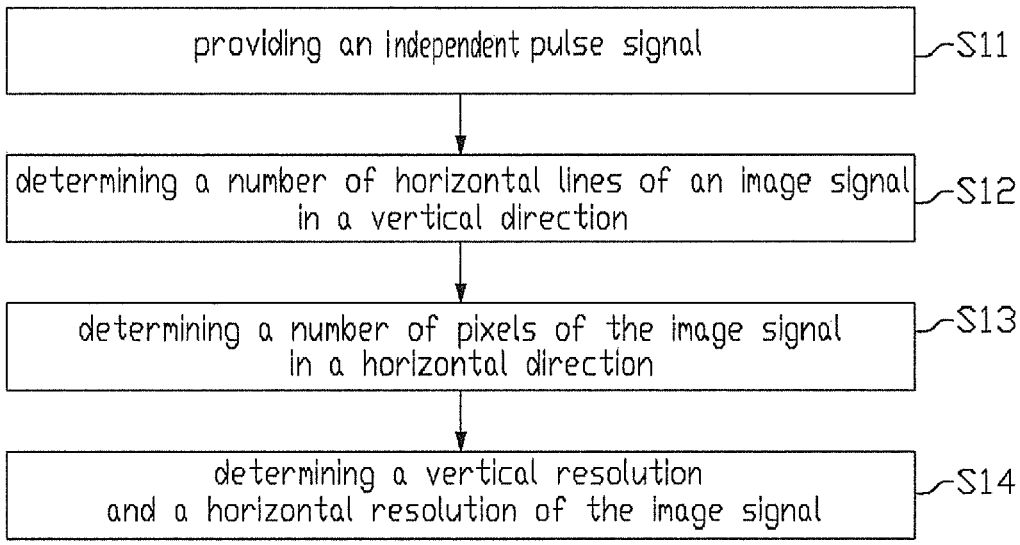
FIG. 3 is a flow chart of a first method for detecting a resolution of an image signal received by the flat panel display of FIG. 1.

Referring to FIG. 3, a flow chart of a first method for detecting the resolution of the image signal is shown. The first method includes the following steps: step S11, providing an EP signal; step S12, determining a number Vtotal of horizontal lines of the image signal in a vertical direction by using the EP signal; step S13, determining a number Htotal of pixel of the image signal in a horizontal direction; step S14, determining a vertical resolution Vactive and a horizontal resolution Hactive of the image signal via a program operation.

In step S11, the pulse generator 330 generates an EP signal, and provides the EP signal to the first and second counters 321, 322. The EP signal is generated by the crystal oscillator of the pulse generator 330 via piezoelectric resonance, and is different from the timing signals of the image signal. A frequency of the EP signal can be preset as 1 Hz or other.

Figure 4:
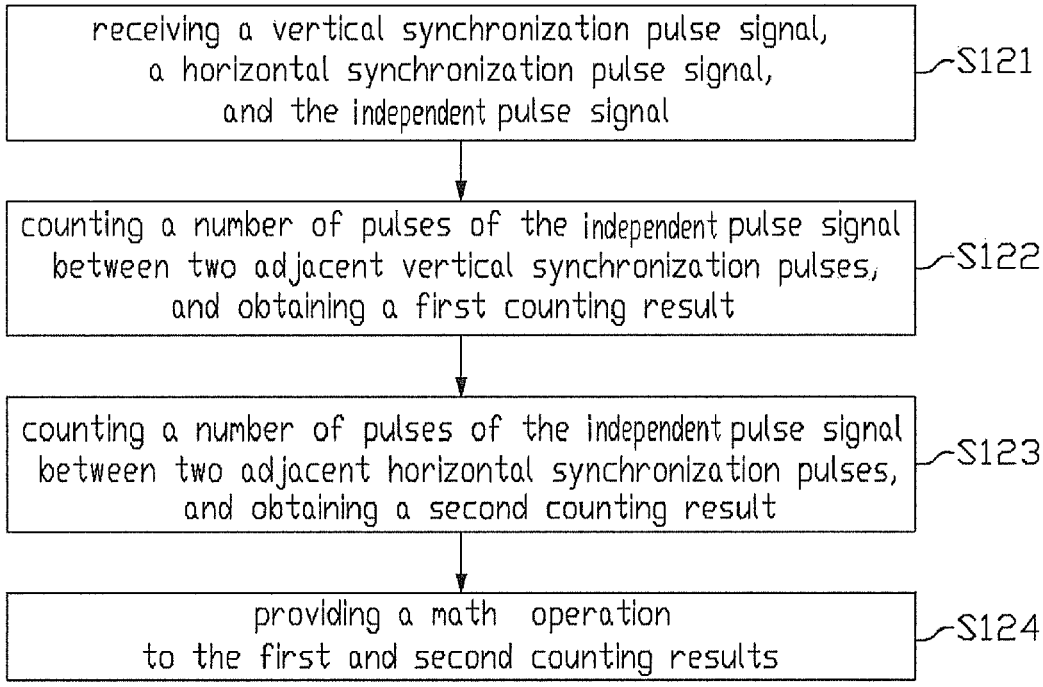
FIG. 4 is a flow chart of a step of the first method of FIG. 3.

Referring to FIG. 4, step S12 includes the following sub steps: sub step S121, receiving a Vsync signal, an Hsync signal, and the EP signal; sub step S122, counting a number of pulses of the EP signal between two adjacent vertical synchronization pulses of the Vsync signal, and obtaining a first counting result Value11; sub step S123, counting a number of pulses of the EP signal between two adjacent horizontal synchronization pulses of the Hsync signal, and obtaining a second counting result Value12; sub step S124, providing a math operation to the first counting result Value11 and the second counting result Value12.

In sub step S121, the first counter 321 receives the Vsync signal from the data interface 310 and the EP signal from the pulse generator 330. The second counter 322 receives the Hsync signal from the data interface 310 and the EP signal from the pulse generator 330.

In sub step S122, the first counter 321 counts the number of pulses of the EP signal between two adjacent vertical synchronization pulses of the Vsync signal, and obtains the first counting result Value11. That is, the first counting result Value11 represents an occurrence number of pulses of the EP signal in a frame of the image signal.

In sub step S123, the second counter 322 counts the number of pulses of the EP signal between two adjacent horizontal synchronization pulses of the Hsync signal, and obtains the second counting result Value12. That is, the second counting result Value12 represents an occurrence number of pulses of the EP signal in a horizontal line of the image signal.

In sub step S124, the maths arithmetic unit 323 receives the first counting result Value11 from the first counter 321 and the second counting result Value12 from the second counter 322, and stores the second counting result Value12. Then the maths arithmetic unit 323 provides a division operation to the first counting result Value11 and the second counting result Value12. A division operation result (or a first operation result) represents the number Vtotal of the horizontal lines of the image signal in vertical direction. That is, Vtotal=Value11/Value12. At last, the maths arithmetic unit 323 outputs the first operation result to the program arithmetic unit 324.

Figure 5A:
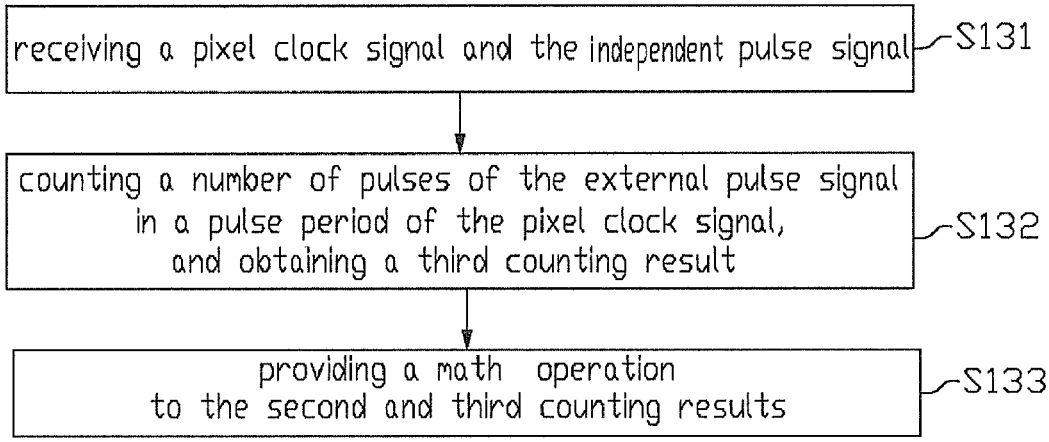
FIG. 5A is a flow chart of another step of the first method of FIG. 3

Referring to FIG. 5A, step S13 includes the following sub steps: sub step S131, receiving a CLK signal and the EP signal; sub step S132, counting a number of pulses of the EP signal in a pulse period of the CLK signal, and obtaining a third counting result Value13; sub step S133, providing a math operation to the second counting result Value12 and the third counting result Value13.

In sub step S131, the first counter 321 receives the CLK signal from the data interface 310 and the EP signal from the pulse generator 330.

In sub step S132, the first counter 321 counts the number of pulses of the EP signal in a pulse period of the CLK signal, and obtains the third counting result Value13. That is, the third counting result Value13 represents an occurrence number of pulses of the EP signal in a pulse period of the CLK signal.

In sub step S133, the maths arithmetic unit 323 receives the third counting result Value13 from the first counter 321, and reads the second counting result Value12. Then the maths arithmetic unit 323 provides a division operation to the second counting result Value12 and the third counting result Value13. A division operation result (or a second operation result) represents the number Htotal of pixels of the image signal in horizontal direction. That is, Htotal=Value12/Value13. At last, the maths arithmetic unit 323 outputs the second operation result to the program arithmetic unit 324.

Figure 5B:
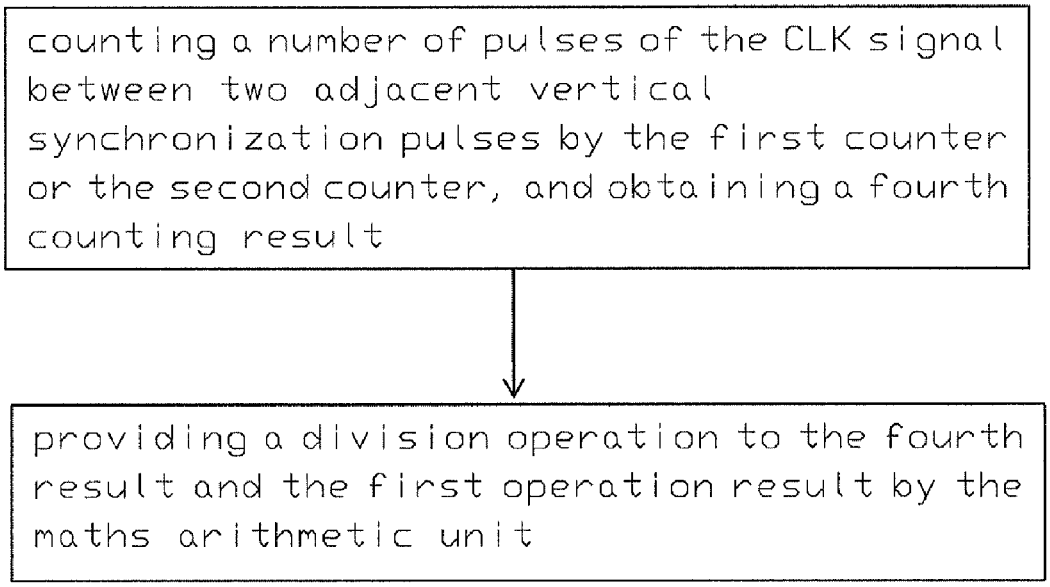
FIG. 5B is a flow chart of a further step of the first method of FIG. 3.

In alternative embodiments, the third counting result Value13 can be also obtained by the second counter 322. Furthermore, referring to FIG. 5B, step S13 can include the following sub steps: firstly, counting a number of pulses of the CLK signal between two adjacent vertical synchronization pulses by the first counter 321 or the second counter 322, and obtaining a fourth counting result Value 14; secondly, providing a division operation to the fourth result Value 14 and the first operation result Vtotal by the maths arithmetic unit 323. A division operation result also can represent the number Htotal of pixels of the image signal in horizontal direction. That is, Htotal=Value14/Vtotal=Value14/(Value11/Value12) =(Value14×Value12)/Value11.

In step S14, firstly, the program arithmetic unit 324 receives the first and second operation results. Secondly, the program arithmetic unit 324 distinguishes the first and second operation results and determines numerical values represented by the results. Thirdly, the program arithmetic unit 324 provides a program operation to detect ranges to which the first and second operation results belong, and determines a format of the image signal according to the ranges. Finally, the program arithmetic unit 324 determines a horizontal resolution Hactive and a vertical resolution Vactive of the image signal according to the format.

For example, if the first counting result Value11 is 1079680, and the second counting result Value12 is 1012, then after step S12, the first operation result Vtotal is 1067. If the fourth counting result Value14 is 1799408, then after step S13, the second operation result Htotal is 1686. When distinguishing the second operation result Htotal as 1686, the program arithmetic unit 324 detects a range from 1660 to 1770 to which the second operation result Htotal belongs, that is, 1660<Htotal<1700. In the VESA specification, a value of Htotal as 1688 of the format SXGA is proximal to the second operation result. Thus, the program arithmetic unit 324 modifies the second operation result to be 1688 according to the format SXGA. In addition, the program arithmetic unit 324 modifies the first operation result to be 1066 according to the format SXGA. Then the program arithmetic unit 324 outputs the vertical resolution Vactive as 1024 and the horizontal resolution Hactive as 1280 according to the format SXGA. That is, the scaler control circuit 320 detects a resolution of the image signal as 1280×1024.

The first method for detecting the resolution of the image signal obtains the number Vtotal of the horizontal lines of the image signal in vertical direction and the number Htotal of pixels of the image signal in horizontal direction by using the EP signal. Due to generated by the pulse generator 330 and provided directly to the scaler control circuit 320, the EP signal is protected from be disturbed by other signals or circumstance factors. Therefore, the counting and operation results obtained by using the EP signal have a high accuracy.

Furthermore, after obtaining the numbers Vtotal and Htotal, the program arithmetic unit 324 provides the program operation based on the VESA specification, which can determine a definite range. The vertical resolution Vactive and the horizontal resolution Hactive of the image signal can be obtained exactly according to the range. That is, the numbers Vtotal and, Htotal can vary in the range. Thus, even if the timing signals of the image signal are disturbed by other signals or circumstance factors, the first method can still accurately detect the resolution of the image signal. Therefore, the first method has a high accuracy.

Figure 6:
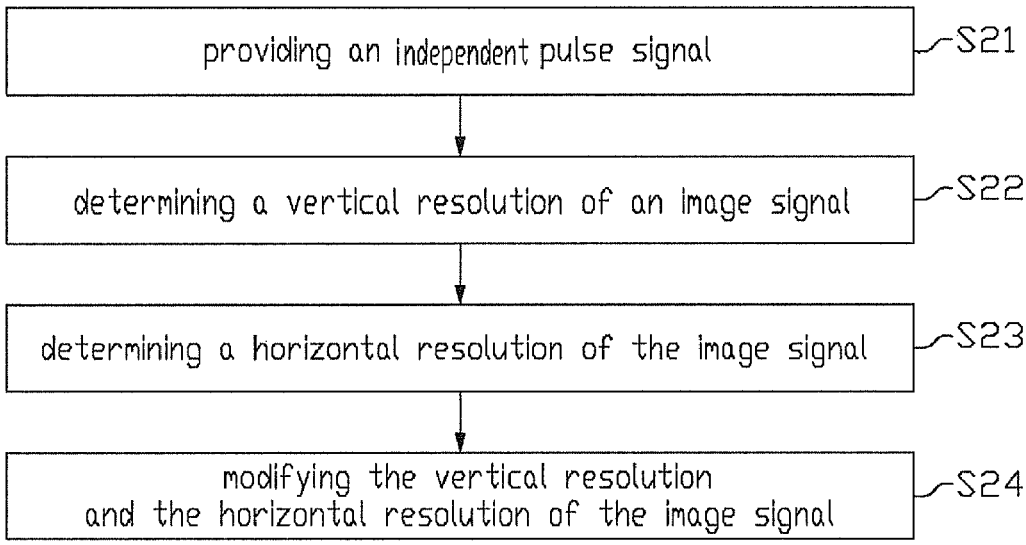
FIG. 6 is a flow chart of a second method for detecting a resolution of an image signal received by the flat panel display of FIG. 1.

Referring to FIG. 6, a flow chart of a second method for detecting the resolution of the image signal is shown. The second method includes the following steps: step S21, providing an EP signal; step S22, determining a vertical resolution Vactive of an image signal by using the EP signal; step S23, determining a horizontal resolution Hactive of the image signal by using the EP signal; step S24, modifying the vertical resolution Vactive and the horizontal Hactive resolution of the image signal via a program operation.

In step S21, the pulse generator 330 generates an EP signal.

Figure 7:
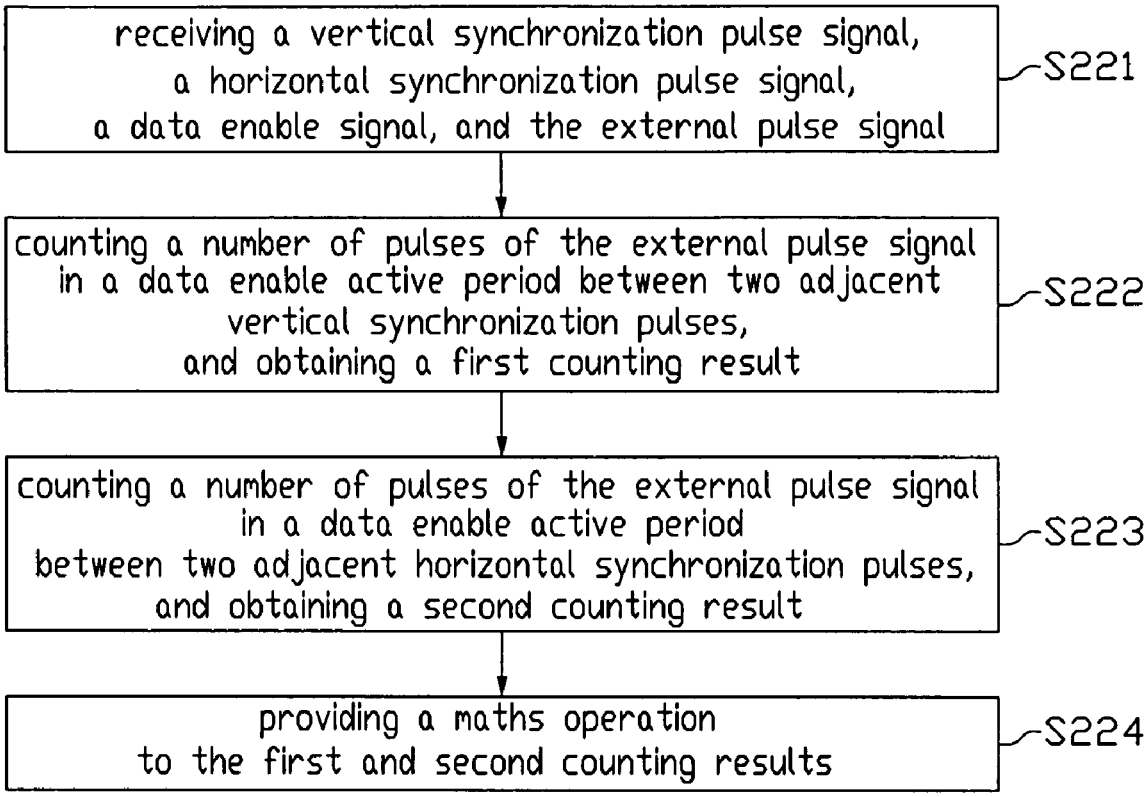
FIG. 7 is a flow chart of a step of the second method of FIG. 6.

Referring to FIG. 7, step S22 includes the following sub steps: sub step S221, receiving a Vsync signal, an Hsync signal, a DE signal, and the EP signal; sub step S222, counting a number of pulses of the EP signal in a DE active period between two adjacent vertical synchronization pulses, and obtaining a first counting result Value21; sub step S223, counting a number of pulses of the EP signal in a DE active period between two adjacent horizontal synchronization pulses, and obtaining a second counting result Value22; sub step S224, providing a math operation to the first counting result Value21 and second counting result Value22.

In sub steps S222 and S223, the counting processes can be finished respectively by the first counter 321 and the second counter 322. In sub step S224, the maths arithmetic unit 323 provides a division operation to the first counting result Value21 and the second counting result Value22. A division operation result (or a first operation result) represents the vertical revolution Vactive of the image signal. That is, Vactive=Value21/Value22.

Figure 8:
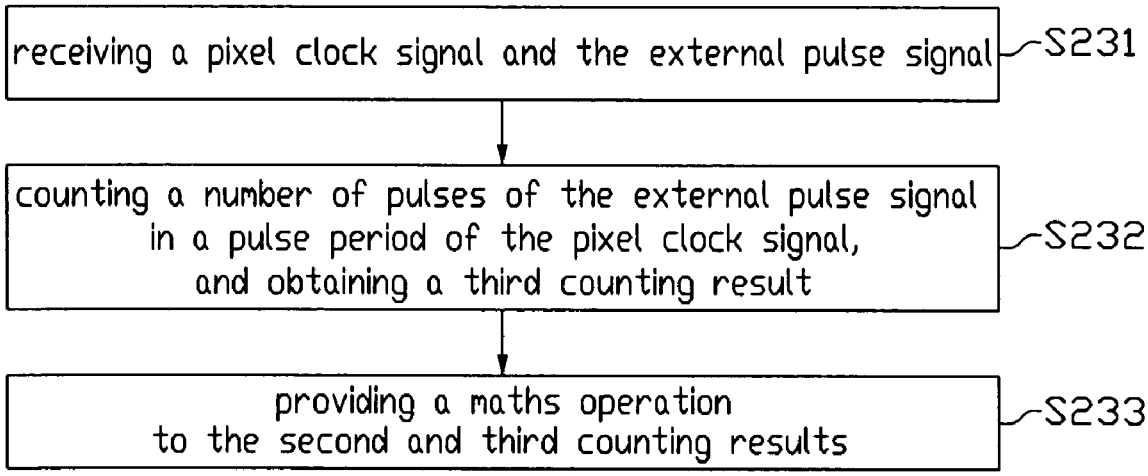
FIG. 8 is a flow chart of another step of the second method of FIG. 6.

Referring to FIG. 8, step S23 includes the following sub steps: sub step S231, receiving a CLK signal and the EP signal; sub step S232, counting a number of pulses of the EP signal in a pulse period of the CLK signal, and obtaining a third counting result Value23; sub step S233, providing a math operation to the second counting result Value22 and the third counting result Value23.

In sub steps S232, the counting processes can be finished respectively by the first counter 321 or the second counter 322. In sub step S233, the maths arithmetic unit 323 provides a division operation to the second counting result Value22 and the third counting result Value23. A division operation result (or a second operation result) represents the horizontal revolution Hactive of the image signal. That is, Hactive=Value22/Value23.

Step S24 is similar to step S14 of the first method. The program arithmetic unit 324 detects ranges to which the first operation result Vactive and the second operation result Hactive belong based on the VESA specification, distinguishes a format of the image signal according to the ranges, modifies the first operation result Vactive and the second operation result Hactive to meet the VESA specification, and outputs the modified vertical revolution Vactive and horizontal resolution Hactive.

The second method for detecting the resolution of the image signal determines the vertical resolution Vactive and the horizontal resolution Hactive of the image signal by using the EP signal and the program operation. Due to generated by the pulse generator 330 and provided directly to the scaler control circuit 320, the EP signal is protected from being disturbed by other signals or circumstance factors. Therefore, the counting and operation results obtained by using the EP signal have a high accuracy. Furthermore, the program arithmetic unit 324 modifies the operation results, even if the operation results have differences from the actual values, the scaler unit 325 can still obtain an accurate resolution of the image signal. Therefore, the second method has a high accuracy.

When the detection process has been finished, the resolution of the image signal is output to the scaler unit 325. The scaler unit 325 scales the resolution of the image signal to match a fixed resolution of the flat panel display 300, and outputs the image signal as a format of low voltage differential signal (LVDS) to the timing controller 340. The timing controller 340 receives the LVDS signal and controls the gate driving circuit 350 and the data driving circuit 360 to drive the display panel 340 to display.

Figure 9:
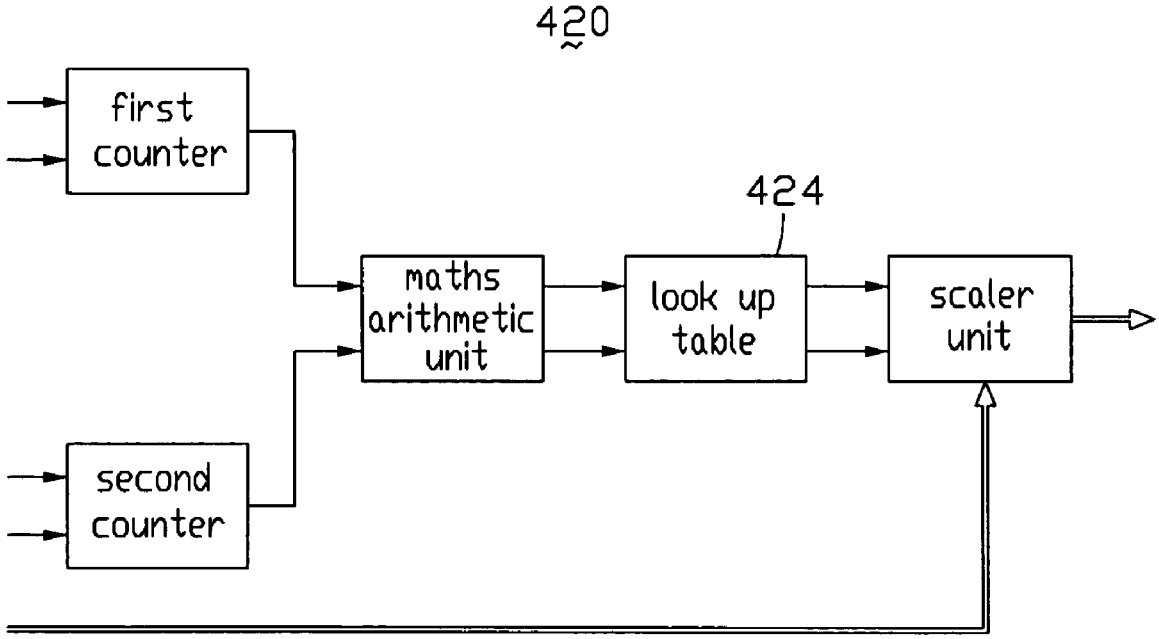
FIG. 9 is a block diagram of a scaler control circuit of a second embodiment of a flat panel display of the present disclosure.
Figure 10:
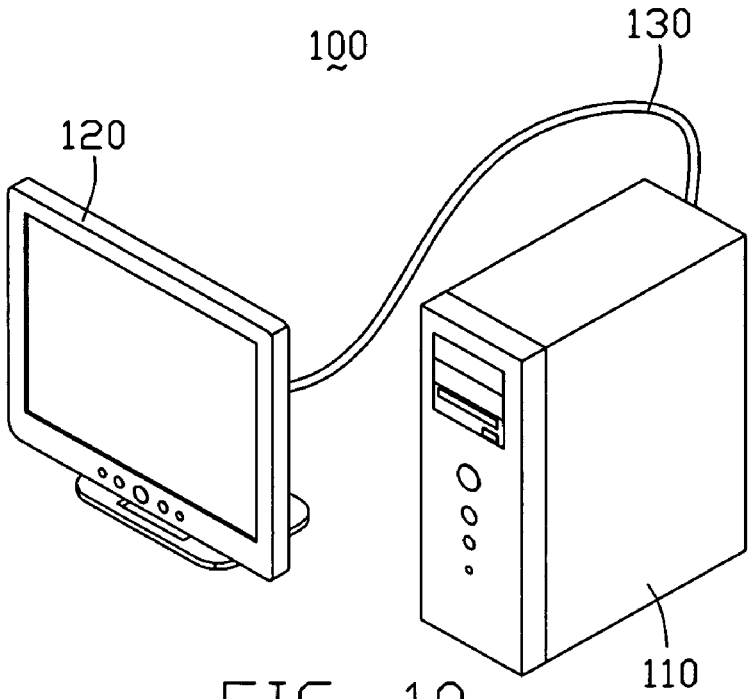
FIG. 10 (RELATED ART)
FIG. 10 is a perspective view of a conventional computer system, the computer system including a flat panel signal having a scaler control circuit.
Figure 11:
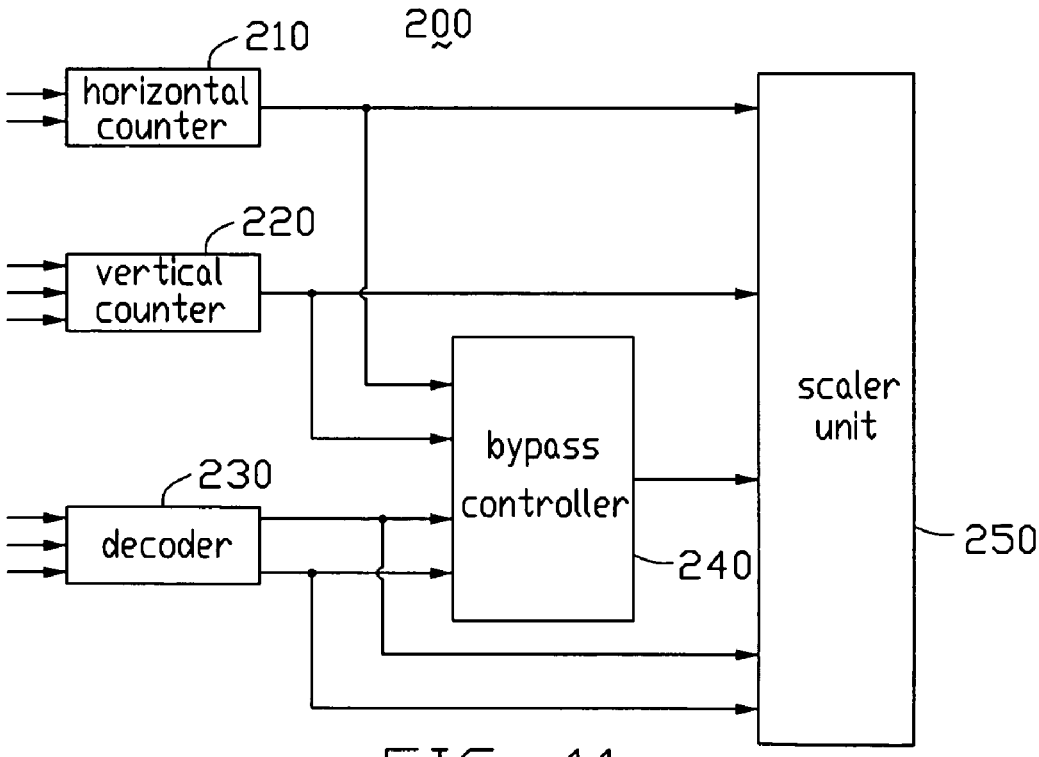
FIG. 11 (RELATED ART)
FIG. 11 is a block diagram of the scaler control circuit of the flat panel signal of FIG. 10.

Referring to FIG. 9, a scaler control circuit 420 of a flat panel display of a second embodiment of the present disclosure is similar to the scaler control circuit 320. The scaler control circuit 420 uses a look up table 424 substituted for the program arithmetic unit 324, and modifies a detected revolution result by using the look up table 424. The look up table 424 is based on the VESA specification, and includes all kinds of formats provided by the VESA specification.

The scaler control circuit 420 distinguishes input signals that represent numerical values, determines definite ranges according to the input signals, finds out the format in the look up table 424 proximal to the ranges; and then outputs active horizontal resolution Hactive and active vertical resolution Vactive according to the format. The scaler control circuit 420 can also use the above two methods to detect a resolution of an image signal just needing to use a step of using the look up table 424 to substitute for the step of using program operation.

It is to be understood that even though numerous characteristics and advantages of the present embodiments have been set forth in the foregoing description with details of the structures and functions of the embodiments, the disclosure is illustrative only, and changes made in detail, especially in matters of shape, size, and arrangement of parts, within the principles of the embodiments, to the full extent indicated by the broad general meaning of the terms in which the appended claims are expressed.

What is claimed is:

1. A flat panel display, comprising:

a data interface configured to receive an image signal comprising a pixel data signal, a pixel clock signal, a vertical synchronization pulse signal, and a horizontal synchronization pulse signal;

a scaler control circuit which has a first counter configured to receive the pixel clock signal and the vertical synchronization pulse signal in order to count a number of pulses of an independent pulse signal between two adjacent vertical synchronization pulses, a second counter configured to receive the pixel clock signal and the horizontal synchronization pulse signal in order to count a number of pulses of the independent pulse signal between two adjacent horizontal synchronization pulses, a math arithmetic unit connected to the first and the second counters and configured to provide a division operation to two counting results output from the first and second counters, a program arithmetic unit connected to the math arithmetic unit and configured to modify a division operation result output from the math arithmetic unit, and a scaler unit connected to the program arithmetic unit and configured to directly receive the pixel data signal in order to scale a resolution of the image signal; and a pulse generator connected to the scaler control circuit and configured to provide the independent pulse signal to the scaler control circuit;

wherein the scaler control circuit is configured to determine a vertical resolution of the image signal by counting a number of pulses of the independent pulse signal respectively between two adjacent vertical synchronization pulses and between two adjacent horizontal synchronization pulses.

2. The flat panel display of claim 1, wherein the two counting results output from the first and second counters comprises a first counting result to represent an occurrence number of pulses of the independent pulse signal in a frame of the image signal, and a second counting result to represent an occurrence number of pulses of the independent pulse signal in a horizontal line of the image signal.

3. The flat panel display of claim 2, wherein the division operation result output from the math arithmetic unit represents the number of the horizontal lines of the image signal in a vertical direction.

4. The flat panel display of claim 2, wherein the scaler control circuit further comprises a look up table configured to modify the division operation result output from the math arithmetic unit.

* * * * *